United States Patent [19]

Steffel

[11] Patent Number: 4,665,860

[45] Date of Patent: May 19, 1987

[54] APPARATUS FOR AUTOMATICALLY HUMIDIFYING THE BEAD OF TIRES MADE OF RUBBER WITH A HUMIDIFYING AGENT

[75] Inventor: Horst Steffel, Gross Gronau, Fed. Rep. of Germany

[73] Assignee: Spezialmaschinenbau Steffel GmbH & Co. KG, Fed. Rep. of Germany

[21] Appl. No.: 778,359

[22] Filed: Sep. 20, 1985

[51] Int. Cl.[4] ..... B05C 1/02

[52] U.S. Cl. ..... 118/215; 118/232; 118/241; 118/247; 118/259

[58] Field of Search ..... 118/215, 214, 232, 233, 118/320, 241, 247, 259

[56] References Cited

U.S. PATENT DOCUMENTS 3,658,152 4/1972 Mueller ..... 118/233 X 4,183,321 1/1980 Ziegelmeyer ..... 118/259

FOREIGN PATENT DOCUMENTS 417309 5/1971 U.S.S.R. ..... 118/215

*Primary Examiner*—John P. McIntosh

*Attorney, Agent, or Firm*—Kinney & Lange

[57] ABSTRACT

An apparatus for automatically humidifying the beads of tires made of rubber with a humidifying agent has a conveyor for retaining and centering a tire received horizontally. An upright humidifying roller is supplied by an applicator with humidifying agent while the roller is rotated. The roller is movable between a standby position below the tire and an operating position within the tire wherein it engages the beads of the tire to apply the humidifying agent thereto. A collecting container is mounted below the humidifying roller to collect surplus humidifying agent flowing from the humidifying roller.

11 Claims, 7 Drawing Figures

APPARATUS FOR AUTOMATICALLY HUMIDIFYING THE BEAD OF TIRES MADE OF RUBBER WITH A HUMIDIFYING AGENT

BACKGROUND OF THE INVENTION

In industrial manufacturing of automotive tires from rubber the tires are subjected to multiple controls. To this purpose the tires are mounted on measuring or control rims. It is usual to humidify the beads of the tires before mounted on the rim in order to easily remove the tires from the control rims after the control operation has carried out. The humidifying agent is a liquid or a paste. It is known to apply the humidifiying medium manually with brushes. Such method is not well suited for automatic manufacturing.

It is further known to apply the humidifying agent directly on the rim or the tire by a spraying device. Also this method has some deficiencies. The known spraying means do not allow the humidifying of the tire seat on the rim solely, rather also the environment of the apparatus will be humidified. Thus the manufacturing machines are contaminated in the region of the spraying device. Also the machines following the spraying device are contaminated by the humidifying agent dropping from the tires. If such tires are mounted to the rims of automobiles it also cannot be avoided that the rims are contaminated by the humidifying agent. If for instance the rims are made of aluminum unremovable stains are left on the rims. It is clear to the man in the art that such rims cannot be used in the automobile manufacturing.

If the beads are sprayed directly with the humidifying agent it cannot be avoided that the side walls and the interior of the tires are humidified too. This contamination has the same deficiencies as described above.

Thus, it is an object of the invention to design an apparatus wherein the humidifying of the beads of automotive tires can be carried out automatically. The apparatus according to the invention is to humidify the bead of the tire solely with a lubricious agent.

SUMMARY OF THE INVENTION

In the apparatus according to the invention a supply conveyor is associated with a humidifying station. The conveyor moves the tires preferably horizontally. Support means in the humidifying station retain and center the tires horizontally to allow a humidifying roller to move within the tire. The humidifying roller is supported by support means for rotation about a vertical axis. The support means is moved between a standby position and a working position by suitable actuating means. In the working position, the humidifying roller engages the tire beads from the interior of the tire. In the resting or standby position the humidifying roller is outwards of the tire, preferably at its lower side. Applying means is associated with the humidifying roller applying the humidifying agent to the humidifying roller. The applying means which are stationary relative to the humidifying roller are connected to a metering pump by which the humidifying agent is supplied to the applying means in measured quantities. A collecting container is located below the humidifying roller collecting the humidifying agent flowing or dropping from the humidifying roller.

Tire and humidifying roller are to rotate relative to each other. It is possible to move the humidifying roller along the inner circumference of the tire whereby the humidifying roller is rolling on the beads. Preferably the humidifying roller is held at its position and the tire is rotated. The humidifying roller can be thus rotated by friction and does not need driving means for its own. However, the humidifying agent is lubricious and therefore it is preferred if also the humidifying roller is rotatably driven.

It should be noted that the metering pump may be replaced by a normal pump, a metering valve may be connected in the line between the pump and the applying means.

There are different ways to rotate a tire in the retaining means about its vertical axis. It is preferred to move the tire during its conveyance, for instance by the roller trains, against vertical abutment rollers which automatically center the tire. If two parallel roller trains are provided one of which being adapted to be driven in both directions the tire may be rotated by means of the roller trains upon engagement with the abutment rollers. It is not necessary to provide further structural means to hold the tire during the humidifying operation. The abutment rollers are preferably supported on a pivotally supported support member. Therefore, the abutment rollers can be moved away after the humidifying operation has taken place. Thereafter the tire may continue its way through the manufacturing line.

The support member carrying the humidifying roller is preferably mounted on a swinging arm which is engaged by spring means. The support member in turn is vertically movably supported on the swinging arm. The support member is moved in vertical direction preferably by two parallel actuating cylinders, the actuating cylinders having passing through piston rods, the ends thereof being connected to a slide carrying the humidifying roller. The mentioned spring means bias the swinging arm and thus exert to the humidifying roller a predetermined force by which the humidifying roller engages the tire beads. An actuating cylinder engaging the swinging arm may pivot the swinging arm against the spring means in order to bring the humidifying roller out of engagement with the tire beads.

There are different ways to supply the humidifying agent from the applying means to the humidifying roller. It is preferred if a groove is formed in a vertical surface parallel to the axis of the humidifying roller, the vertical surface extending adjacent the circumference of the humidifying roller or having a small distance therefrom. The groove preferrably starts at the upper end of the humidifying roller, and its length depends on the viscosity of the humidifying agent. The length of the groove is proportional to the viscosity of the humidifying agent. If the humidifying agent is liquid it may flow downwardly on the circumference of the humidifying roller by gravity. If a paste is used the groove preferably extends throughout the total height of the humidifying roller. The bottom of the groove is connected with the passage in the applying means, the passage in turn is connected to the metering pump.

In the apparatus according to the invention a collecting container is located below the humidifying roller, the collecting container being also mounted on the support means. Surplus humidifying agent flowing from the humidifying roller is collected in the collecting container. The collecting container is preferably arranged about the bearing shaft or driving shaft of the humidifying roller such that the agent cannot enter the bearing or the driving means. Therefore, a contamination of the apparatus according to the invention with humidifying agent does not take place. The collecting container has preferably an overflow. Liquid medium may thus be transferred to a further collecting container and removed. The first collecting container below the roller collects dust and particles which adhere to the bead as a result from the manufacturing operations and from friction. The collecting container thus serves as a sump. The first collecting container only needs to be cleaned at large time intervals.

The metering pump always supplies fresh humidifying agent to the applying means so that always agent having the desired viscosity is applied to the beads of the tires. With the apparatus according to the invention a lot of advantages are achieved. With the humidifying roller only the beads which are in contact with the rim are humidified with a humidifying agent. A contamination of manufacturing machines or of the rims is excluded. The apparatus according to the invention permits an exact metering of the humidifying agent. The apparatus according to the invention is suitable for a wide range of viscosity of humidifying agent, i.e. suited for liquid or paste-like agents. During an operation the viscosity remains constant and thus also the humidifying rate.

By means of the abutment rollers and the double roller train a quick and easy centering and rotation of the tires is achieved. Therefore, cycle time and further expenses for apparatuses is saved.

BRIEF DESCRIPTION OF THE DRAWINGS

The invention is explained below under consideration of drawings.

It is expressly emphasized that the illustrations in the Figures are extremely schematical and not in full scale.

DETAILED DESCRIPTION OF THE PREFERRED EMBODIMENTS

Figure 2:
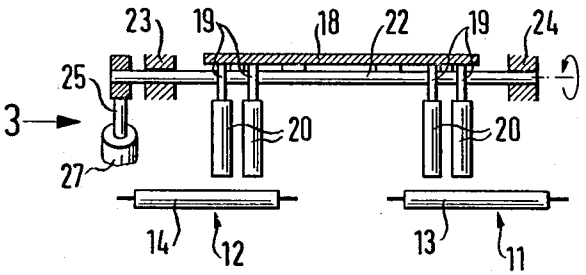
FIG. 2 shows a cross section through FIG. 1 along the line 2—2.
Figure 1:
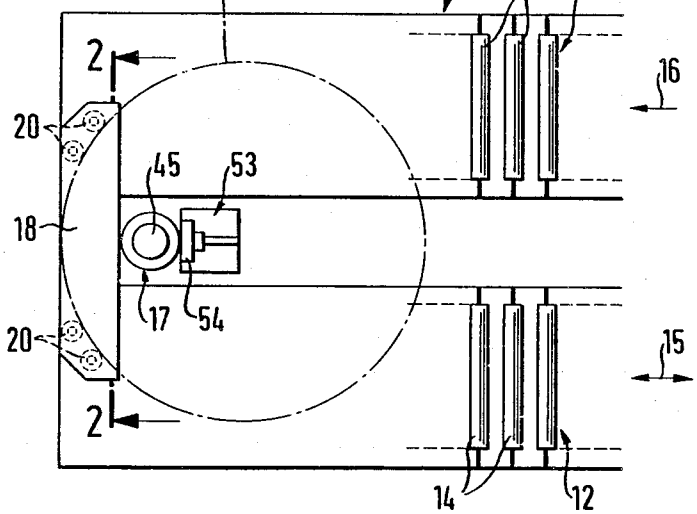
FIG. 1 shows a view on a humidifying apparatus according to the invention illustrated schematically.
Figure 5:
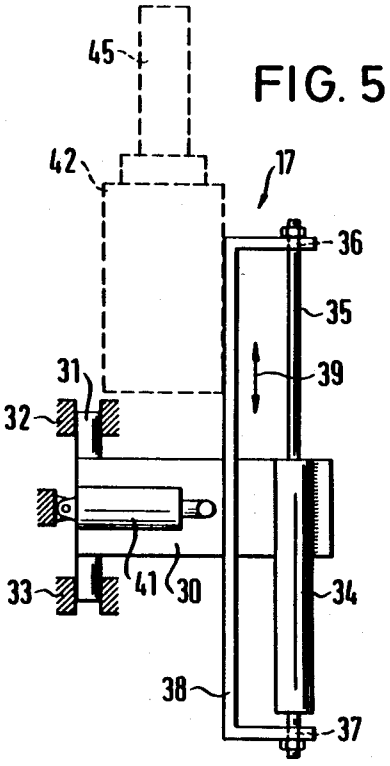
FIG. 5 shows another elevational view of the apparatus of FIG. 4.
Figure 4:
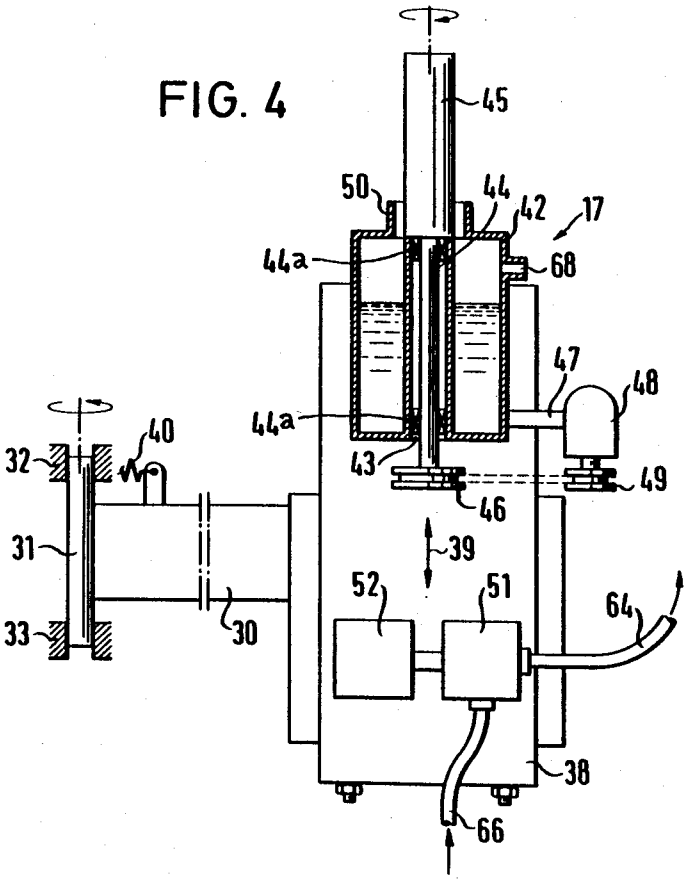
FIG. 4 shows schematically the elevation view of the humidifying apparatus according to the invention.

In a frame 10 which is not shown in detail two roller trains 11, 12 are disposed which in a manner known per se include rollers 13 and 14. The rollers 13, 14 are driven by separated driving means (not shown). The driving means for the roller train 12 is reversible so that the roller train 12 can convey in both directions which is indicated by the double arrow 15. The roller train 11 only conveys in one direction which is indicated by arrow 16. The roller trains 11, 12 extend horizontally. In the space between the roller trains 11, 12 a humidifying apparatus 17 is located which will be explained hereinafter. A support plate 18 is located above the roller trains 11, 12 parallel to the plane of the rollers 13, 14. Support rods 19 are connected to the plate 18 and extend vertically downwardly. Abutment rollers 20 are rotatably supported on the support rods 19. In the apparatus shown in FIGS. 1 and 2 four abutment rollers 20 are provided, pairwisely associated with a roller train 11 or 12, respectively. The axes of the abutment rollers are located on an arc, the center thereof lying on a center line between the roller trains 11, 12. The roller trains 11, 12 are adapted to convey tires towards the abutment rollers 20. The abutment rollers 20 automatically effect a centering of the tires which is indicated in FIG. 1. A tire 21 engaging the abutment rollers 20 is indicated by a dash-dotted line.

Figure 3:
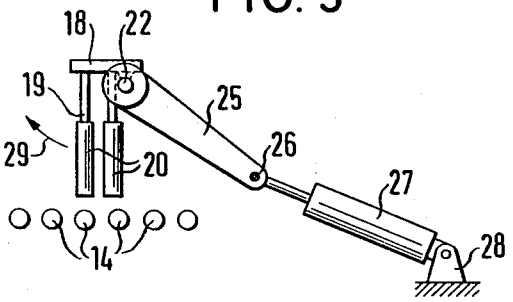
FIG. 3 shows a view of the apparatus of FIG. 2 if looked in the direction of arrow 3 in FIG. 2.

A shaft 22 extends below the plate 18, the shaft being rotatably supported at its both ends at 23 and 24 in the frame 10. As can be seen in FIG. 3 one end of the shaft 22 is connected to a swivel arm 25, the lower end thereof being connected at 26 to a distance rod of an actuating cylinder 27. The actuating cylinder 27 is connected to the frame 10 at 28. A shaft 22 is firmly secured to the plate 18, e.g. by welding. If the actuating cylinder 27 is actuated the plate 18 rotates about the axis of the shaft 22. By this the abutment rollers 20 are raised in the direction of arrow 29 (FIG. 3). After sufficient elevation of the abutment rollers a tire 21 can be conveyed further by the roller trains 11, 12.

It has already been mentioned that the roller train 12 may be driven in both directions. If a tire 21 engages abutment rollers 20 and the roller train 12 is driven backwardly and the roller train 11 is driven forwardly the tire 21 engaging the abutment roller 20 is rotated. Such rotation is anti-clock-wise.

The humidifying apparatus 17 will be explained by means of FIGS. 4 to 7. The swinging or retaining arm 30 is located below the roller trains 11, 12, the swinging arm 30 being pivotally supported by the frame 10 by means of a vertical support rod within bearings 32 and 33 of frame 10. The swinging arm 30 is equipped with two actuating cylinders, one of which is to be seen in FIG. 5 at 34. The actuating cylinders 34 are parallel to each other and each includes a passing through piston rod 35. Both ends of the piston rods 35 are connected to a slide 38 at 36 or 37, respectively. The slide 38 can be raised or lowered (see double arrow 39). The actuating cylinder 34 represent actuating means and guide means for the slide 38 as well. A spring 40 engages the swinging arm 30 and biases the arm 30 in a first rotational direction. The piston rod of an actuating cylinder 41 engages the arm 30 and is adapted to move the swinging arm 30 in the opposite rotational direction.

The slide 38 is formed as a plate on which a collecting container 42 is mounted. The collecting container 42 includes a central passage 43 through which a driving shaft is extended, the driving shaft 44 being connected to a humidifying roller 45 above the collecting container. The passage 43 includes the bearings **44*a* for the driving shaft 44. A pulley 46 is mounted on the lower end of the shaft 44. A cantilever 47 is mounted on the collecting container 42, and a driving motor 48 is mounted on the cantilever 47. The motor 48 has a pulley 49 which is operable connected to the pulley 46. Therefore, the shaft 44 and thus the humidifying roller 45 can be rotated by the motor. The upper end 50 of the collecting container 42 is spaced radially from the humidifying roller 45 and surrounds the lower portion of the roller 45**.

A metering pump 51 is also mounted on the slide 38 and is driven by a motor 52.

Figure 6:
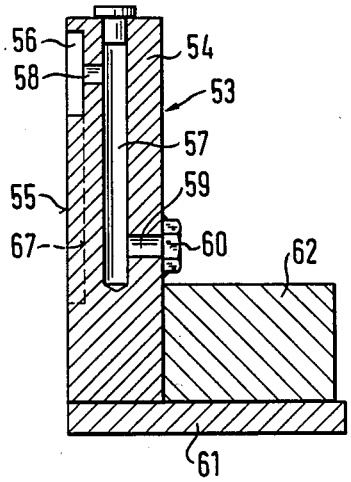
FIG. 6 shows a section through the applying means for the humidifying roller of the humidifying apparatus of the FIGS. 1 to 4.
Figure 7:
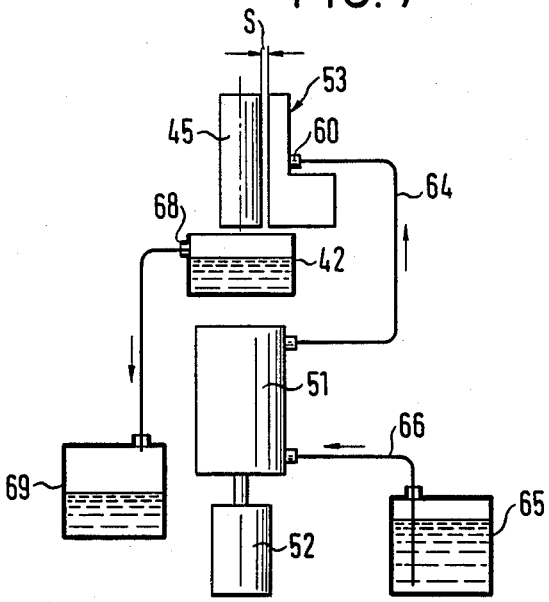
FIG. 7 shows schematically the flow of the humidifying agent in the humidifying apparatus according to the invention.

As can be seen in FIGS. 1 and 7 an applying device 53 is associated with the humidifying roller 45. As can be seen in FIG. 6 an upright plate 54 is tangentially located with respect to the circumference of the humidifying roller 45 (see also FIG. 1). The plate 54 may engage the humidifying roller 45. Alternatively, the plate may be spaced a small distance from the circumference of the roller which is indicated at S in FIG. 7. A surface 55 of the plate 54 facing the humidifying roller 45 has a groove 56, the axis of the groove extending parallel to the axis of the humidifying roller 45. A vertical bore 57 is formed in the plate 54 which is in communication with the groove 56 through a transverse bore 58. A further transverse bore 59 is formed at the lower end of the bore 57 which is connected through a conduit through a fitting 60. The plate 45 stands on a plate 61. A block 62 on plate 61 is connected to the plate 61 on the upright plate 54. The applying device 53 in FIG. 6 is also tightly connected to slide 38 (see FIGS. 4 and 5).

As can be seen in FIG. 7 fitting 60 is connected to the outlet of the metering pump 51 by conduit 64. The metering pump 51 supplies fresh humidifying agent from a container 65 mounted on the frame 10 through conduits 66 and 64 to the applying device 53. In case the humidifying agent has a small viscosity it is sufficient when the groove 56 has a small length. It should be mentioned that the groove 56 starts substantially with the upper end of the humidifiying roller 45. The more viscous the humidifying agent is the longer the groove 56 is to be chosen. In case paste-like humidifying agent is used the groove extends substantially over the total height of the humidifying roller 45 which is indicated by the dash-line 67 in FIG. 6. In case of a paste-like agent the paste must be supplied to the metering pump under pressure.

It is clear that the circumference of the metering roller 45 must be of suitable material, for instance of relatively hard plastic material, rubber or the like. However, it should be noted that the roller 45 is not restricted to the mentioned materials.

Since the humidifying roller 45 is rotated, the agent can uniformly applied to the beads of the tire. Surplus agent flows into the collecting container 42 which has an overflow 68. Liquid agent flows through the overflow into a further collecting container 69. Therefore only contaminants remain in collecting container 42 which has to be cleaned from time to time.

From the description above it can be seen that the humidifying roller 45 can be moved in a horizontal plane and in a vertical direction by means of the swinging arm 30 and the slide 38. If a tire 21 is approaching the the abutment rollers 22, the humidifying roller 45 is in its standby position below the roller trains 11, 12. The actuating cylinder 41 is retaining the arm 30 in this position wherein the roller 45 is within a range which is defined by the smallest inner circumference of a tire 21. If the tire 21 engages the abutment roller 20 then the slide 38 is moved upwardly so that the roller 45 is plunging the tire 21. Thereafter, the actuating cylinder 41 is relieved. The spring 40 pivots the arm 30 until the humidifying roller 45 engages both beads (bead bases) of the tire 21 with a predetermined pressure. The tire 21 thereafter is rotated in the manner describes above. Further the humidifying roller 45 is driven by the motor 48 with a predetermined speed. The metering pump 51 supplies lubricious humidifying agent to the applying device 53 so that the humidifying of the beads may take place about the total circumference. When this operation is terminated the actuating cylinder 41 is again actuated by pressure and the humidifying roller 45 moves away from the beads. Now the slide 38 is moved in its lower resting position by the actuating cylinders 34.

By using a suitable control device the operation of the humidifying apparatus described can be carried out automatically. The control device detects the position of the individual movable parts and transmits control signals to the actuating means according to a predetermined program.

I claim:

1. An apparatus for automatically humidifying the beads of tires made of rubber by means of a humidifying agent, comprising supply conveying means (11, 12) for conveying the tires (21) horizontally and individually to a humidifying station, retaining means (18, 20) in the humidifying station for retaining and centering a tire at a fixed position as received from the conveying means, said tire being rotated about a vertical axis in the retaining means, a humidifying roller (45), support means (38) in the humidifying station for supporting the humidifying roller for rotation about a vertical axis, the humidifying roller being driven by a motor, applying means (53) associated with the circumference of the humidifying roller, the applying means being connected to a metering pump (51) driven by a pump motor (52), the metering pump being connected to a source (65) for humidifying agent, the applying means including an applying surface (55) which is stationarily arranged and located tangentially relative to the circumference of the humidifying roller to engage the circumference of the humidifying roller with a vertical groove (56) parallel to the axis of the humidifying roller being formed in the applying surface, the metering pump being connected to said groove through its output conduit to deliver humidifying agent thereto, a collecting container (42) mounted on the support means directly below the humidifying roller, surplus humidifying agent dropping downwardly from the humidifying roller into the collecting container, and actuating means (34, 40, 41) engaging the support means for vertically moving the humidifying roller between a stand-by position between a tire within the retaining means and an operating position wherein the humidifying roller plunges within said tire and is adapted to engage the beads of said tire.

2. The apparatus according to claim 1, wherein the retaining means include roller retaining means (18) which supports abutment rollers (20) for rotation about a vertical axis, the abutment rollers being supported slightly above the supply conveying means (11, 12) with the axes thereof lying on an arc.

3. The apparatus according to claim 2, wherein the supply conveying means include two separate parallel roller trains (11, 12) which are driven by separate driving means with the driving means of at least one of the roller trains being adapted to drive said one roller train in both directions, whereby if both roller trains are driven in the same direction a tire (21) is moved towards the abutment rollers (20) and wherein a tire in engagement with the abutment rollers is rotated about a vertical axis if said one roller train is driven in an opposite direction.

4. The apparatus according to claim 2, wherein the roller retaining means (18) is horizontally supported and adapted to be pivoted upwardly about a horizontal axis, and wherein an actuating cylinder (22) engages the roller retaining means (18) through a swivel arm (25).

5. The apparatus according to claim 1, wherein the support means include a swinging arm (30) pivotally supported in the humidifying station, a slide (38) vertically movably mounted with respect to the swinging arm with the slide supporting the humidifying roller (45) and the collecting container (42), actuating means (34) for moving the slide vertically relative to the swinging arm, spring means (40) for engaging the swinging arm such that the humidifying roller is biased towards its tire engaging position, and an actuating cylinder (41) engaging the swinging arm (30) in order to move the swinging arm against the biasing of the spring means and bring the humidifying roller out of engagement with the tire (21).

6. The apparatus according to claim 5, wherein the actuating means include two parallel actuating cylinders (34) having passing through piston rods (35), with both ends of each piston rod being connected to the slide (38).

7. The apparatus according to claim 1 wherein the collecting container (42) surrounds a lower end of the humidifying roller (45), with bearing means supporting the humidifying roller being sealed relative to the collecting container.

8. The apparatus according to claim 1, wherein a vertical driving shaft (44) connected to the lower end of the humidifying roller (45) is sealingly extended through the collecting container (42).

9. The apparatus according to claim 1, wherein the collecting container (42) includes an overflow (68) which is connected to a second movable collecting container (69).

10. The apparatus according to claim 1, wherein an upper end of the vertical groove (56) is substantially aligned to the upper end of the humidifying roller (45).

11. The apparatus according to claim 1, wherein the applying surface (55) of the applying means (53) is spaced slightly from the circumference of the humidifying roller (45).

* * * * *